US007013514B1

(12) United States Patent
Byer

(10) Patent No.: US 7,013,514 B1
(45) Date of Patent: Mar. 21, 2006

(54) FIRE RETARDANT MATTRESS

(75) Inventor: Steve Byer, Simsbury, CT (US)

(73) Assignee: Blue Bell Mattress Co., Inc., Windsor, CT (US)

( * ) Notice: Subject to any disclaimer, the term of this patent is extended or adjusted under 35 U.S.C. 154(b) by 0 days.

(21) Appl. No.: 10/965,588

(22) Filed: Oct. 14, 2004

(51) Int. Cl.
*A27C 27/00* (2006.01)

(52) U.S. Cl. ..... 5/698; 5/700; 5/954
(58) Field of Classification Search ..... 5/698, 5/483, 690, 700, 954; 297/DIG. 5; 428/920, 428/443
See application file for complete search history.

(56) References Cited

U.S. PATENT DOCUMENTS

| | | | | |
|---|---|---|---|---|
| 3,818,521 | A * | 6/1974 | Richards, Jr. | 5/698 |
| 4,866,799 | A | 9/1989 | Glackin | |
| 6,609,261 | B1 | 8/2003 | Mortensen et al. | |
| 6,718,583 | B1 | 4/2004 | Diaz | |
| 2004/0158928 | A1 | 8/2004 | Gladney | |

* cited by examiner

*Primary Examiner*—Heather Shackelford
*Assistant Examiner*—Frederick Conley
(74) *Attorney, Agent, or Firm*—Cantor Colburn LLP

(57) ABSTRACT

Embodiments of the invention include a fire retardant mattress including a quilt panel positioned at a top sleeping surface of the mattress. A top fire retardant layer is positioned adjacent to the quilt panel. A side panel is positioned at a side surface of the mattress. A side fire retardant layer is positioned adjacent to the side panel. A bottom panel is positioned at a bottom surface of the mattress. Bottom fire retardant material is positioned only around the periphery of the bottom panel.

12 Claims, 1 Drawing Sheet

FIRE RETARDANT MATTRESS

BACKGROUND

The invention relates generally to fire retardant mattresses and in particular to a fire retardant mattress proving fire retardant material on a portion of the bottom surface of the mattress.

There exists a need to render mattresses fire retardant. Existing mattress designs incorporate fire retardant materials to comply with regulatory requirements. An upcoming regulatory standard is defined in California Bureau of Home Furnishings Technical Bulletin 603, which is to become enacted Jan. 1, 2005. It is expected that the Consumer Product Safety Division will enact a federal standard Jan. 1, 2006 that will mimic 603, albeit not identical. One technique for providing a fire retardant mattress is taught in published U.S. Patent application 20040158928. This publication describes using a fire barrier fabric in the top, sleeping surface and on the sides or borders of the mattress. This design, however, does not accommodate for fire retardant material in the bottom of the single sleeping surface sided mattress.

SUMMARY

Embodiments of the invention include a fire retardant mattress including a quilt panel positioned at a top, sleeping surface of the mattress. A top fire retardant layer is positioned adjacent to the quilt panel. A side panel is positioned at a side surface of the mattress. A side fire retardant layer is positioned adjacent to the side panel. A bottom panel is positioned at a bottom surface of the mattress. Bottom fire retardant material is positioned only around the periphery of the bottom panel.

DETAILED DESCRIPTION

Figure 1:
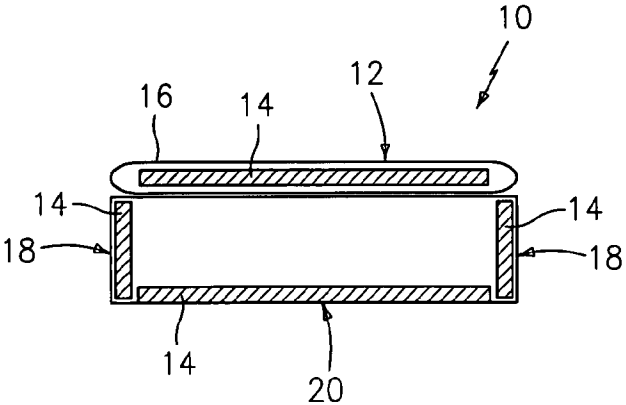
FIG. 1 depicts a mattress in an embodiment of the invention.

FIG. 1 depicts a mattress in an embodiment of the invention. Mattress is a single sleeping surface sided mattress. Mattress 10 includes a top, sleeping surface 12 having a fire retardant (FR) material 14 embedded within a quilt panel 16. In embodiments of the invention, the FR material 14 is Esyntial FR Safe TB24 manufactured by Western Nonwoven. Quilt panel 16 may include conventional components, such as backing, foam material, filler material, ticking etc. along with the FR material 14. In an alternate embodiment, the FR material 14 is positioned beneath the top quilt panel rather than embedded within the top quilt panel 16.

Sides 18 include FR material 14, either embedded in a side panel or behind a side panel as described in further detail herein. Bottom 20 includes FR material 14, but only around the periphery of the bottom as described in further detail herein. This reduces the amount of FR material used in the bottom and reduces the cost of the mattress.

Figure 2:
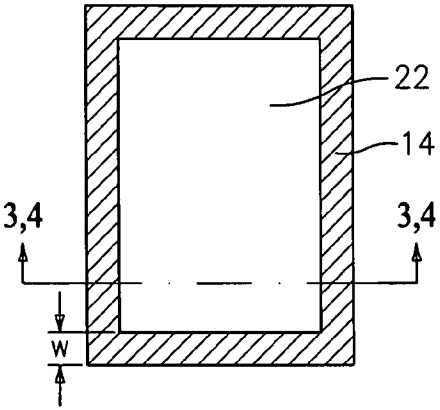
FIG. 2 is a bottom view of a mattress in an embodiment of the invention.

FIG. 2 is a bottom view of mattress 10 illustrating the FR material 14 around the periphery of the bottom surface 20. The FR material 14 may be secured to a bottom panel 22 of conventional backing material. Alternatively, the bottom FR material may be secured to the mattress core. The FR material 14 is secured to the mattress or the bottom panel using any known technique such as stapling, stitching, gluing with an adhesive, heat pressing, etc. In yet another embodiment, the bottom FR material is laid, but not secured, in place behind the bottom panel 22. The FR material may be positioned on the inside or the outside of the bottom panel 22. The bottom panel 22 may be made from standard upholstery material such as polypropylene, polyester, cotton or combinations of natural and synthetic materials. The bottom FR material 14 may have lower fire retardant properties when compared to the FR material in the top layer and the side layer. Such materials are less costly and are more akin to a fabric than a fiber. An exemplary FR material for use in the bottom layer is Stratus brand FR material from Haynes.

The width w of the strip of FR material 14 may vary depending on the desired fire retardant effect. In an exemplary embodiment, width w is approximately 3 inches, but it is understood that any width may be used and the invention is not limited to a specific dimension. By using a flange of FR material 14 around the periphery of the bottom surface 20, the cost in manufacturing the mattress is reduced when compared to covering the entire bottom surface with FR material.

Figure 3:
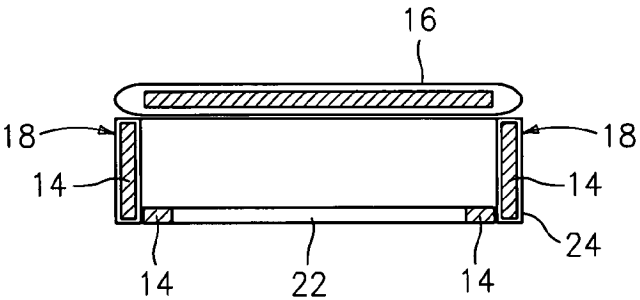
FIG. 3 is a cross-sectional view taken along line 3—3 in FIG. 2 in an embodiment of the invention.

FIG. 3 is a cross-sectional view taken along line 3—3 of FIG. 2. As shown in FIG. 3, sides 18 include FR material 14 embedded within a side panel 24. Side panel 24 may include conventional components, such as backing, filler material, ticking, etc. along with the FR material 14. Also shown in FIG. 2 is the FR material 14 in the bottom panel 22 along the periphery of bottom panel 22. FR thread may be used where fire retardant quality is desired.

Figure 4:
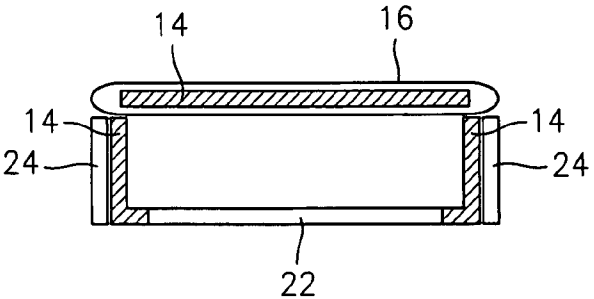
FIG. 4 is a cross-sectional view taken along line 4—4 in FIG. 2 in an alternate embodiment of the invention.

FIG. 4 is a cross-sectional view taken along line 4—4 of FIG. 2. As shown in FIG. 4, side panel 24 does not include any embedded FR material. Rather, the FR material 14 from the bottom extends upwards towards the top of the mattress to cover the side. Side panel 24 may include conventional components, such as backing, filler material, ticking, etc. As in all embodiments, FR thread may be used where fire retardant quality is desired.

Figure 5:
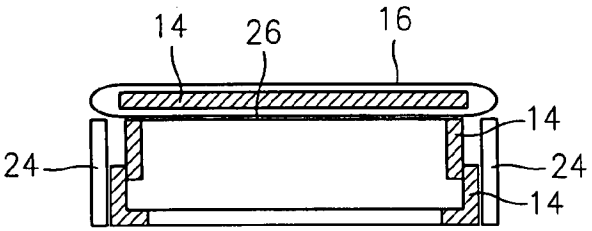
FIG. 5 is a cross-sectional view depicting an alternate implementation of FIG. 4.

FIG. 5 is a cross-sectional view depicting an alternate implementation of FIG. 4. As shown in FIG. 5, the FR material 14 in the sides extends upwards from bottom panel 22 and downwards from a top layer 26 positioned beneath the quilt panel 16. The FR material from the top and bottom overlap to provide FR protection to sides 18.

While the invention has been described with reference to exemplary embodiments, it will be understood by those skilled in the art that various changes may be made and equivalents may be substituted for elements thereof without departing from the scope of the invention. In addition, modifications may be made to adapt to a particular situation or material to the teachings of the invention without departing from the essential scope thereof. Therefore, it is intended that the invention not be limited to the particular embodiments disclosed for carrying out this invention.

What is claimed is:

1. A fire retardant mattress comprising:

a quilt panel positioned at a top sleeping surface of the mattress, the mattress having a single sleeping surface;

a top fire retardant layer positioned adjacent to the quilt panel;

a side panel positioned at a side surface of the mattress;

a side fire retardant layer positioned adjacent to the side panel;

a bottom panel extending substantially along the entire bottom surface and positioned at a bottom surface of the mattress;

bottom fire retardant material positioned only around the periphery of the bottom panel;

the bottom fire retardant material is positioned on an inside surface of the bottom panel, the bottom fire retardant material being parallel to the bottom panel.

2. The fire retardant mattress of claim 1 wherein:

the top fire retardant layer is positioned within the quilt panel.

3. The fire retardant mattress of claim 1 wherein:

the top fire retardant layer is positioned beneath the quilt panel.

4. The fire retardant mattress of claim 1 wherein:

the side fire retardant layer is positioned within the side panel.

5. The fire retardant mattress of claim 1 wherein the side fire retardant layer is positioned behind the side panel.

6. The fire retardant mattress of claim 5 wherein:

the side fire retardant layer is joined to the bottom fire retardant material.

7. The fire retardant mattress of claim 5 wherein:

the side fire retardant layer extends from the top surface and extends from the bottom surface.

8. The fire retardant mattress of claim 1 wherein:

the bottom fire retardant material is secured to the bottom panel by at least one of sewing, adhesive, heat bonding or stapling.

9. The fire retardant mattress of claim 1 wherein:

the bottom fire retardant material is secured to a mattress core by at least one of sewing, adhesive, heat bonding or stapling.

10. The fire retardant mattress of claim 1 wherein:

the bottom fire retardant material is laid adjacent to the bottom panel.

11. A fire retardant mattress comprising;

a quilt panel positioned at a top sleeping surface of the mattress, the mattress having a single sleeping surface;

a top fire retardant layer positioned adjacent to the quilt panel;

a side panel positioned at a side surface of the mattress;

a side fire retardant layer positioned adjacent to the side panel;

a bottom panel extending substantially along the entire bottom surface and positioned at a bottom surface of the mattress;

bottom fire retardant material positioned only around the periphery of the bottom panel and being parallel to the bottom panel, the bottom fire retardant material not overlapping the side fire retardant material.

12. A fire retardant mattress comprising:

a quilt panel positioned at a top sleeping surface of the mattress, the mattress having a single sleeping surface;

a top fire retardant layer positioned adjacent to the quilt panel;

a side panel positioned at a side surface of the mattress;

a side fire retardant layer positioned adjacent to the side panel;

a bottom panel extending substantially along the entire bottom surface and positioned at a bottom surface of the mattress;

bottom fire retardant material positioned only around the periphery of the bottom panel;

the bottom fire retardant material and the side fire retardant layer are made from a continuous piece of fire retardant material, continuous piece of fire retardant material extending along the side panel and along the bottom panel, the portion of the continuous piece of fire retardant material forming the bottom fire retardant material being parallel to the bottom panel.

* * * * *